US005174810A

United States Patent [19]

Dosaj et al.

[11] Patent Number: 5,174,810

[45] Date of Patent: Dec. 29, 1992

[54] FERROSILICON SMELTING IN A DIRECT CURRENT FURNACE

[75] Inventors: Vishu D. Dosaj; James B. May, both of Midland, Mich.

[73] Assignee: Dow Corning Corporation, Midland, Mich.

[21] Appl. No.: 837,389

[22] Filed: Feb. 19, 1992

[51] Int. Cl.[5] ..... C01B 33/02

[52] U.S. Cl. ..... 75/10.61; 75/10.50; 75/10.51

[58] Field of Search ..... 75/10.51, 10.61, 10.50

[56] References Cited

U.S. PATENT DOCUMENTS 3,215,522 11/1965 Kuhlman et al. ..... 75/10.58
4,820,341 4/1989 Lask ..... 75/10.61
4,865,643 9/1989 Goins et al. ..... 75/10.63
4,898,712 2/1990 Dosaj et al. ..... 420/578
5,009,703 4/1991 Arvidson et al. ..... 423/350

*Primary Examiner*—Peter D. Rosenberg
*Attorney, Agent, or Firm*—William F. Boley

[57] ABSTRACT

The present invention is a process for smelting ferrosilicon alloy. The process comprises adding a carbon source and tailings comprising oxides of silicon and iron to a substantially closed furnace. Heat is supplied to the furnace by striking a direct current arc between a cathode electrode and an anode functional hearth. In a preferred embodiment of the present invention, the cathode electrode is hollow and feed to the substantially closed furnace is through the hollow electrode.

14 Claims, 1 Drawing Sheet

FERROSILICON SMELTING IN A DIRECT CURRENT FURNACE

This invention was made with government support under DE-AC07-87ID12624 awarded by the U.S. Department of Energy. The government has certain rights in this invention.

BACKGROUND OF INVENTION

The present invention is a process for smelting ferrosilicon alloy. The process comprises adding a carbon source and tailings comprising oxides of silicon and iron to a substantially closed furnace. Heat is supplied to the furnace by striking a direct current arc between a cathode electrode and an anode functional hearth. In a preferred embodiment of the present invention, the cathode electrode is hollow and feed to the substantially closed furnace is through the hollow electrode.

Kuhlman, U.S. Pat. No. 3,215,522, issued Nov. 2, 1965, describes a process for producing silicon metal-bearing alloys in an electric furnace. The process involves packing a mixture of silica, alloying ingredients such as reducible metal compounds or reduced metal, and a carbonaceous reducing agent around at least one hollow carbonaceous electrode. The feed to the furnace is separated into coarse and fine materials, with the fine material being added to the process through the hollow electrode and the coarse material being added to the furnace through an open top. The process described by Kuhlman uses a submerged-arc to supply heat to the furnace burden and effect smelting.

Goins et al., U.S. Pat. No. 4,865,643, issued Sep. 12, 1989, describes electrometallurgical processes for producing elemental silicon and silicon alloys in a furnace using a hollow direct current electrode as a heat source. The furnaces described by Goins et al. have open-tops. Goins et al. teach creating a bed of a carbonaceous reducing agent within the hollow electrode. Silicon monoxide containing off-gas from the smelting process is drawn through the hollow electrode and the silicon monoxide is reduced by the carbonaceous reducing agent to silicon.

Arvidson et al., U.S. Pat. No. 5,009,703, issued Apr. 23, 1991, describes a process for preparing silicon metal and silicon metal alloys in a substantially closed, direct current, submerged-arc furnace.

Dosaj et al., U.S. Pat. No. 4,898,712, issued Feb. 6, 1990, describe a process for preparing ferrosilicon in a closed two-stage reduction furnace. In the described process, carbon monoxide released as a result of the smelting process occurring in the first stage of the furnace is used to prereduce higher oxides of iron contained in the second stage of the furnace. The reduced oxides of iron are then used as a feed to the first stage of the furnace. Dosaj et al. teach that the heat provided to the furnace can be by means of an open or submerged graphite electrode connected to an alternating current or direct current power source. Dosaj et al. teach that iron oxide containing ores or their tailings can be used as a feed to the furnace.

Various embodiments of the present invention offer many of the following advantages over the prior art. First, the use of a substantially closed furnace reduces emission of oxides such as silicon monoxide and carbon monoxide to the environment. Second, the use of a substantially closed furnace reduces venting of fines from the furnace and increases feed utilization. Third, the use of a direct current power source reduces both power consumption and electrode consumption. Fourth, the use of a hollow electrode allows fines to be fed directly to the reaction zone of the furnace, facilitating the smelting process. Finally, the ability of the described furnace configuration to smelt fines allows the use of low cost feed materials such as coke breeze and tailings from iron ore refining.

SUMMARY OF INVENTION

The present invention is a process for smelting ferrosilicon alloy. The process comprises adding a carbon source and tailings comprising oxides of silicon and iron to a substantially closed furnace. Heat is applied to the furnace by striking a direct current arc between a cathode electrode and an anode functional hearth. In a preferred embodiment of the present invention, the cathode electrode is hollow and feed to the substantially closed furnace is through the hollow electrode.

DESCRIPTION OF DRAWINGS

Figure 1:
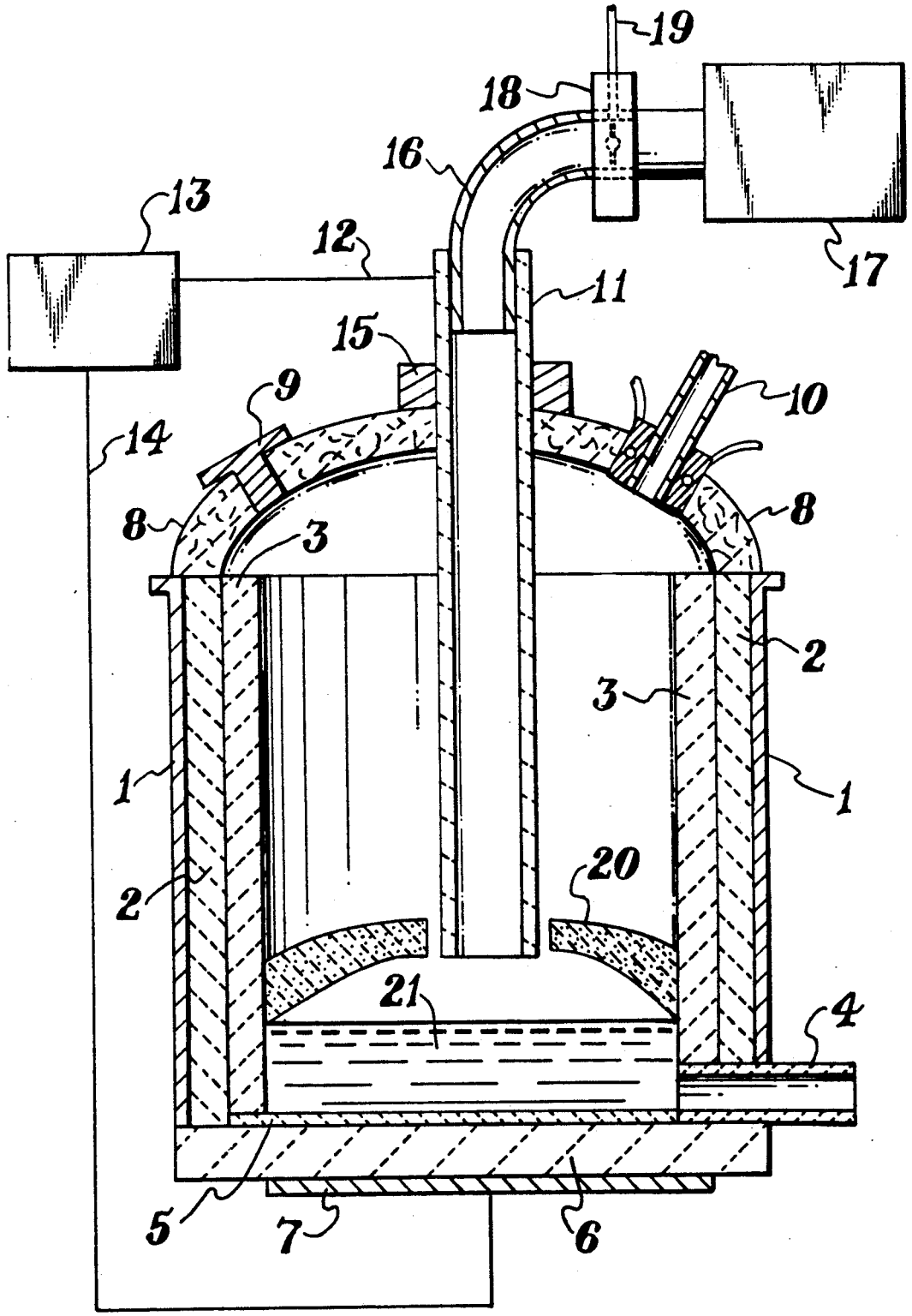
FIG. 1 is a schematic representation of a furnace configuration and operating mode for a dc open arc furnace suitable for the present process.

FIG. 1 illustrates a basic furnace configuration suitable for use in the present process. The furnace body consists of a sidewall, an anode functional hearth, and a roof. The sidewall is composed of outer metal shell 1, alumina refractory layer 2, and carbon paste layer 3. Inserted within the side wall of the furnace body is tap port 4, formed from a carbon block. The sidewalls are supported on an anode functional hearth composed of carbon layer 5, conductive refractory layer 6, and conductive plate 7. The top of the furnace body is enclosed by roof 8. Roof 8 is of dome shaped design and formed from castable 90 percent alumina with stainless steel filament reinforcement. Roof 8 has openings for occludable access port 9, water-cooled vent 10, and hollow electrode 11. Electrode 11, which serves as a cathode for electrical energy supplied to heat the furnace, is connected by electrical connection 12 to dc power supply 13. Dc Power supply 13 is connected to conductive plate 7 by electrical connection 14 to complete the electrical circuit. Electrode 11 is positioned within the electrode opening in roof 8 by electrode positioning device 15, which allows vertical adjustment of electrode 11 within the furnace body. Electrode 11 is connected by conduit 16 to hopper 17. Conduit 16 contains rotary air lock valve 18. Rotary air lock valve 18 allows materials to be fed from hopper 17 to electrode 11, while maintaining a positive pressure gas flow through electrode 11. Positive pressure gas flows through electrode 11 is created by supplying a pressurized gas through gas inlet 19 to rotary air lock valve 18.

In a preferred embodiment of the present invention, the feed of a source of carbon and tailings comprising oxides of silicon and iron to the furnace is controlled to create a cap 20 of solid materials above the end of electrode 11. Molten ferrosilicon 21 is formed in the bottom of the furnace beneath cap 20.

DESCRIPTION OF INVENTION

The present invention is a process for the preparation of ferrosilicon alloy. The process comprises:

(A) adding a carbon source and tailings comprising oxides of silicon and iron to a substantially closed furnace;

(B) heating the substantially closed furnace with a direct current arc; and (C) tapping ferrosilicon alloy from the substantially closed furnace.

The carbon source which is added to the substantially closed furnace can be, for example, carbon black, charcoal, coal, coke, wood chips, or coke breeze. The preferred carbon source is coke breeze, where the coke breeze is a by-product of a coking process. The by-product coke breeze can serve as an inexpensive carbon source for the process. The form of the carbon source can be, for example, powder, granule, chip, lump, pellet, and briquette. An advantage of smelting ferrosilicon in a substantially closed direct current (dc) open-arc furnace is that the particle size of the feed materials to the furnace is not critical. However, in a preferred embodiment of the present process, utilizing a hollow cathode electrode to feed materials to the furnace, it is important that the particle size be such that the feed materials will pass through the hollow electrode. Optimal particle size will depend upon the bore of the electrode. For example, the inventors have found that particles under ¼ inch in diameter can be satisfactorily passed through a bore of two inches or greater.

Theory suggests that in order for the furnace to be in carbon balance at 100 percent yield, one mole of fixed carbon should be added for each mole of reducible oxygen assuming no iron oxide is reduced by carbon monoxide. Fixed carbon is that carbon remaining after volatiles are expelled. In general, the described process can be satisfactorily run in the range of about 0.8 to 1.4 moles of fixed carbon per mole of reducible oxygen. However, it is preferable to run the furnace at slightly less than theoretical carbon balance to accommodate yields of less than 100 percent. A preferred range for the mole ratio of fixed carbon to reducible oxygen is about 0.9 to 1.2. The carbon source can be added to the furnace separately or mixed with the tailings comprising oxides of silicon and iron. The carbon can be added to the furnace through both occludable access ports located in the furnace and through the hollow electrode, if present. By "occludable access port" is meant one or more openings into the interior of the furnace body which can be closed when not being used to prevent or reduce the escape of by-product gas from the furnace. The occludable access port can be located in the roof of the furnace or in the sidewall of the furnace above the furnace burden.

Tailings comprising oxides of silicon and iron are added to the furnace, where the tailings are the remains from ore concentration procedures. The tailings can be, for example, from the ore concentration of taconite, magnetite, hematite, and limonite. The preferred source of tailings comprising oxides of silicon and iron is taconite. The tailings comprising oxides of silicon and iron can be added to the furnace separately or as a mixture with the carbon source. The tailings comprising oxides of silicon and iron can be added to the substantially closed furnace through both occludable access ports located in the furnace and through the hollow electrode.

In a preferred process, the carbon source and tailings comprising oxides of silicon and iron are added through one or more occludable access ports in a manner to form a cap comprising the carbon source and tailings comprising oxides of silicon and iron above the tip of a hollow electrode. This cap formation can be facilitated by simultaneously feeding a mixture of the carbon source and tailings comprising oxides of silicon and iron through the hollow electrode under positive pressure.

The furnace employed in the process of the present invention is substantially closed. By "substantially closed" it is meant that the furnace has a roof for retaining by-product gases within the furnace. Because of the heat accumulation associated with a substantially closed furnace, it is preferred that the roof of the furnace be protected with a refractory having heat resistance comparable or greater than that of 90 percent alumina refractory. Refractories with lessor heat resistance will work, but the useful life of the furnace roof may be diminished.

The roof of the substantially closed furnace also contains one or more vents for removing by-product gases from the furnace. It is preferred that the vent pipe be lined with a refractory having heat resistance at least as great as 70 percent alumina. The optimal internal bore of the vent pipe will depend on such factors as the flow rate of the off-gas and the amount of fume in the off-gas. Too large of an internal bore of the vent pipe will result in a low flow rate for off-gas causing the off-gas fume to plug the vent pipe. Likewise too small a bore for the vent pipe can result in off-gas fume plugging the vent pipe. By way of example, for a 1.2 MW furnace the preferred bore diameter for the vent pipe was found to be about 12 inches.

The substantially closed furnace is heated by a direct current arc. The arc can be a submerged-arc or an open-arc. By "submerged-arc," it is meant that a substantial length of the cathode electrode is covered by the burden of the furnace. By "open-arc" it is meant that the cathode electrode is not substantially covered by the feed materials or ferrosilicon within the furnace. The dc current is derived by rectification from a three phase alternating current source. The rectifier can be, for example, a SCR bridge rectifier.

The use of a dc arc as an energy source for the process offers numerous operational efficiencies over conventional alternating current (ac) furnaces. For example, in a typical three electrode ac furnace, phase imbalance can occur which leads to different operation of each of the three electrodes. These imbalances hinder the control and efficiency of the smelting process and cause harmful electrical noise and harmonics in the power distribution system. The dc power system does not have these problems.

Furthermore, the dc system can be configured to limit current to a setpoint condition. Variability in the system can then be monitored as variation in voltage. This simplifies control of the furnace, since the current can be set and the voltage controlled to setpoint by adjusting the arc length. This fixed current method, by measuring voltage as a function of electrode distance from the hearth, allows a predictive relationship to be established between voltage and arc length. Therefore, position of the cathode within the furnace can be easily assessed. In this manner, the power can be more accurately maintained to the furnace.

Direct current also provides higher power for a given amperage because dc has no attendant power factor due to current lag. A typical three phase, ac furnace operates at about a 0.7 power factor. Therefore, at a given power input and voltage, the current in the secondary bussing will be about 1/0.7 for an ac system as compared to the current for a dc system. Direct current circuits also have a 40 percent higher design ampacity than ac, because dc has no skin effect. This allows the use of smaller electrical buss and reduced diameter of the cathode electrode for the same current input.

Because a dc system can achieve the same power at a lower current, electrode consumption is lower. This is because electrode consumption is approximately proportionate to the square of the current, therefore, the lower current results in lower electrode consumption. Also, oxidation losses of the electrode are reduced in a substantially closed furnace due to the reduction of oxygen in contact with the electrode and also due to the lower surface exposure of the cathode electrode for the same current input.

A dc arc is struck between a cathode electrode inserted through the roof of the furnace and an anode functional hearth. The cathode electrode can be, for example, a graphite electrode, a carbon electrode, or a Soderberg electrode. Preferred is a graphite electrode, because the graphite electrode has a lower resistance than prebaked carbon electrodes or Soderberg electrodes. As a result of this lower resistance, a smaller electrode can be utilized for a given current carrying capability.

A preferred cathode electrode is a hollow graphite electrode. The diameter of the bore of the hollow electrode will depend upon, among other factors, the external diameter of the hollow electrode, the required current carrying capacity of the electrode, the size of materials to be fed through the bore, and the required rate of feed of materials to the furnace. In general when the diameter of the feed materials is less than about ¼ inch, a bore of greater than about two inches has been found acceptable.

Feeding a mixture of the carbon source and tailings comprising oxides of silicon and iron directly into the arc zone through the hollow electrode results in improved furnace efficiency. This increased efficiency is due to a) enhanced mass transfer by mixing of the feed materials, b) improved heat transfer by feeding the mix directly into the arc, and c) improved reaction rate due to the use of fines which have a high surface area of reaction.

Feed of the carbon source and tailings to the hollow electrode can be accomplished by any standard apparatus for feeding solid particulate materials. The feed can be, for example, by gravity feed from one or more live bottom hoppers. Other conveyance means such as weight belt feeders and screw conveyors may also be used alone or in combination to facilitate feed of materials to the hollow electrode.

In a preferred mode, a flow of a non-combustable gas, such as nitrogen, is maintained through the hollow electrode to facilitate movement of materials through the hollow electrode. Therefore, it is preferred that the apparatus for feeding solid particulate materials to the hollow electrode be separated by a valve, such as a rotary air lock valve, to allow a positive pressure gas flow to be maintained through the hollow electrode.

It is desirable that the cathode electrode be adjustable in a vertical direction, since this allows adjustment of the arc length and consequently voltage of the system. The vertical adjustment of the cathode electrode is also necessary to compensate for consumed electrode.

The term "anode functional hearth" refers to any configuration of the bottom of the furnace which can serve as a negative terminal to which an arc can be struck from the cathode electrode. The configuration of the anode functional hearth is not critical to the present process. The anode functional hearth may be, for example, a conductive metal plate, such as copper, contacted with the bottom of the furnace.

In a preferred arrangement, the anode functional hearth consists of an innermost carbon layer, which can be a heat cured carbon paste or carbon or graphite blocks placed on an electrically conductive refractory material forming the furnace bottom. A copper plate is contacted with the exterior of the electrically conductive refractory material to complete the hearth arrangement. The electrically conductive refractory material forming the furnace bottom can be, for example, a graphite-magnesite brick.

Molten ferrosilicon alloy is tapped from the furnace by means of a tap port located in the bottom or side wall of the furnace. The ferrosilicon alloy can contain from about 10 weight percent to 90 weight percent silicon. Preferred is when the ferrosilicon alloy contains about 45 weight percent to 75 weight percent silicon. The weight percent of silicon in the ferrosilicon alloy may be adjusted during the smelting process by feeding a source of silicon dioxide, such as quartz, or a source of iron, such as scrap iron or iron oxides to the process.

The following is offered as an example of an embodiment of the present process. The example is offered for illustration purposes only and is not meant to limit the scope of the claims herein.

EXAMPLE

A 1.2 megawatt (MW), direct current (dc) plasma furnace similar in design to that described in FIG. 1 was employed to smelt taconite tailings in the presence of coke breeze as a carbon source. The weight percent (Wt. %) of major components of the taconite tailings are given in Table 1.

TABLE 1

| Composition of Taconite Tailings | |
|---|---|
| Component | Wt. % |
| $Fe_2O_3$ | 18.12 |
| FeO | 8.91 |
| $SiO_2$ | 64.61 |
| CaO | 1.29 |
| MgO | 1.96 |
| $CO_2$ | 4.14 |
| Ignitables | 4.74 |

Approximately 99.9 percent of the taconite tailings as received passed through a number 3 mesh screen (¼ inch). with the mode for particle size distribution being between a number 6 mesh to number 8 mesh.

The weight percent of the major components of the coke breeze is presented in Table 2.

TABLE 2

| Coke Breeze Composition | |
|---|---|
| Component | Wt. % |
| Fixed Carbon | 67.5 |
| $SiO_2$ | 8.9 |
| $Al_2O_3$ | 4.5 |
| MgO | 3.1 |
| Volatiles | 7.5 |
| $H_2O$ | 6.2 |

The inside space of the furnace was about 60 inches wide and 42 inches high. The cathode electrode was a 10 inch diameter graphite electrode about 5 feet in length. The cathode electrode contained a 2.5 inch bore down the center. The hollow electrode was positioned in the roof of the furnace by a water-cooled copper clamp spring loaded in the clamping position and pneumatically released. The hollow electrode was raised and lowered within the furnace by a cable and pulley arrangement.

Feed to the furnace was by means of two live-bottom bins on load cells, two weight belt feeders, an inclined screw conveyor, and a rotary air lock valve. One weight hopper system was used to feed taconite tailings and the other weight hopper system was used to feed coke breeze. The hoppers were each of 40 cubic foot capacity. The feed system was manufactured by Vibra Screw Inc., Totawa, NJ.

The desired quantities of taconite tailings and coke breeze were dropped into the inclined screw conveyer and then passed through the rotary air lock valve into the center bore of the electrode. The rotary air lock valve allowed materials below the valve to be pressurized with nitrogen gas to assist gravity drop of the feed materials into the furnace through the hollow electrode.

The power supply to the furnace was of a standard design for converting an alternating current into a stable direct current suitable for a smelting furnace.

The design of the off-gas vent pipe was of particular importance to the successful operation of the furnace. The off-gas vent pipe employed in this example consisted of a steel pipe lined with a 70% alumina refractory, resulting in an opening of 12 inches through which off-gases could pass. A water cooled collar was fitted around the lower section of the off-gas vent pipe. Off-gases were vented to standard treatment equipment for combusting gases and removing particulates.

Initially 2200 lbs of steel punchings were placed in the bottom of the furnace to form a heel. During heat-up of the furnace, coke breeze was added through the hollow electrode. Once the furnace reached operating temperature, a mixture of taconite and coke breeze was added to the furnace.

The furnace was operated for 34 hours utilizing 13,660 kWh of electricity. A total of 2690 lbs of taconite and 2264 lbs of coke breeze was fed to the furnace through the hollow electrode and 1240 lbs of taconite and 754 lbs of coke breeze were fed through an occludable access port located in the roof of the furnace. Seven taps were made collecting 985 lbs of ferrosilicon. The volume of ferrosilicon tapped from the furnace ranged from 50 to 250 lbs per tap. Taps 4 and 7 were analyzed to contain 28 weight percent and 39 weight percent respectively of silicon.

It was observed during the run that a large amount of feed material had formed a near perfect cylinder about 4 inches larger in diameter than the electrode and located above the electrode tip. This cylinder partially capped the reaction zone, while maintaining an open annulus around the electrode which allowed off-gases to escape from the reaction zone. This partial capping of the reaction zone improved the recovery of silicon by reducing the silicon monoxide vented from the furnace and also reduced the temperature on the roof of the furnace thereby prolonging the life of the refractory-lined roof.

We claim:

1. A process for preparation of ferrosilicon alloy, the process comprising:

(A) adding a carbon source and tailings comprising oxides of silicon and iron to a substantially closed furnace;

(B) heating the substantially closed furnace with a direct current arc: and (C) tapping ferrosilicon alloy from the substantially closed furnace.

2. A process according to claim 1, where the direct current arc is struck from a hollow graphite electrode.

3. A process according to claim 2, where the tailings comprising oxides of silicon and iron are added to the substantially closed furnace through the hollow graphite electrode.

4. A process according to claim 2, where the carbon source is added to the substantially closed furnace through the hollow center of the graphite electrode.

5. A process according to claim 1, where the carbon source is coke breeze.

6. A process according to claim 1, where the tailings comprising oxides of silicon and iron are taconite.

7. A process according to claim 1, where the direct current arc is an open-arc.

8. A process according to claim 1, where the direct current arc is a submerged-arc.

9. A process according to claim 1, where the ferrosilicon alloy contains about 45 weight percent to 75 weight percent silicon.

10. A process according to claim 1, further comprising adding a source of iron to the substantially closed furnace in addition to that present in the tailings comprising oxides of silicon and iron.

11. A process according to claim 10, where the source of iron in addition to that present in the tailings comprising oxides of silicon and iron is scrap iron.

12. A process according to claim 1, further comprising adding a source of silicon dioxide in addition to that present in the tailings comprising oxides of silicon and iron.

13. A process according to claim 2, where a cap comprising the carbon source and tailings comprising oxides of silicon and iron is formed above the tip of the graphite electrode.

14. A process for preparation of ferrosilicon alloy, the process comprising:

(A) adding coke breeze and taconite tailings to a substantially closed furnace through a hollow graphite electrode.

(B) heating the substantially closed furnace with a direct current open-arc, and (C) tapping ferrosilicon alloy from the substantially closed furnace.

* * * * *